United States Patent [19]

Goodman

[11] Patent Number: 5,026,049

[45] Date of Patent: Jun. 25, 1991

[54] LEG STRETCHING APPARATUS

[76] Inventor: John F. Goodman, Rte. 1, Box 59, Worley, Id. 83876

[21] Appl. No.: 567,761

[22] Filed: Aug. 15, 1990

[51] Int. Cl.[5] ..... A63B 21/00

[52] U.S. Cl. ..... 272/126; 272/903; 272/144

[58] Field of Search ..... 272/126, 903, 144; 297/283, 284, 423, 427, 433, 431

[56] References Cited

U.S. PATENT DOCUMENTS

| | | | |
|---|---|---|---|
| 1,885,750 | 11/1932 | Miller, Jr. | 297/427 |
| 2,591,306 | 4/1952 | Sherman | 297/284 |
| 2,598,985 | 6/1952 | Everest et al. | 297/433 |
| 4,531,730 | 7/1985 | Chenera | 272/144 |
| 4,608,969 | 9/1986 | Hamlin | 128/73 |
| 4,647,040 | 3/1987 | Ehrenfried | 272/126 |
| 4,781,373 | 11/1988 | Irwin | 272/126 |
| 4,815,732 | 3/1989 | Mahri | 272/903 |
| 4,844,453 | 7/1989 | Hestilow | 272/130 |
| 4,877,239 | 10/1989 | Rosa | 272/126 |

*Primary Examiner*—Richard J. Apley
*Assistant Examiner*—Karen G. Horowitz
*Attorney, Agent, or Firm*—James D. Givnan, Jr.

[57] ABSTRACT

An apparatus including a pair of swingable arms with each having a leg engaging member. The arms are powered toward an open or aligned relationship to cause the leg engaging members to spread the user's legs to increase leg flexibility and the range of leg movement during the practice of martial arts. A threaded shaft journalled on a base of the device receives a wrench and moves a traveler sleeve and a pair of links acting on said arms. The leg engaging members are positionable along the arms for different sized users with the members having pads oppositely spaced from a knee joint to engage the upper leg and the lower leg. The leg engaging member are asymmetrically mounted on sleeves to permit varying the vertical distance of the leg engaging members above a floor surface to accommodate a wide range of adult and child users.

4 Claims, 1 Drawing Sheet

LEG STRETCHING APPARATUS

BACKGROUND OF THE INVENTION

The present invention concerns equipment of the type found in gymnasiums and fitness centers as well as in the home for exercising purposes.

Practioners of karate, including both adults and children, utilize the legs in several maneuvers and accordingly leg flexibility is highly desirable. Such flexibility is achieved by regular stretching of certain muscles of the upper leg. Toward this end a number of stretching devices have been disclosed in the following U.S. Pat. Nos.: 3,921,975; 4,277,062; 4,781,373; 4,877,239; and 4,844,453. Generally the devices shown for imparting stretching movement to the upper legs include a pair of swingably mounted, diverging arms which act on the legs to impart horizontal opening movement to the legs. Various means are disclosed for actuating the swingably mounted arms. A serious drawback to the proposed mechanisms is the complexity of same resulting in prohibitive cost of such equipment. A further drawback to known stretching devices is that they are not readily adaptable for use by both adults and children.

SUMMARY OF THE PRESENT INVENTION

The present invention is embodied within an upper leg stretching apparatus which imparts opening movement to the legs of a wide range of users including adults and children.

The present apparatus utilizes a pair of swingably mounted arms which swing apart toward an open position in response to movement of a traveler sleeve along a threaded jack shaft. The apparatus includes a floor supported base on which is journalled the threaded shaft with the shaft end receiving a ratchet tool for convenient rotation of the shaft. Leg engaging members on the arms are adjustable along the arms to suit the user. Additionally, the leg engaging members may be inverted to locate leg engaging pads thereon at different distances above a floor surface for the purpose of accommodating both adults and children.

Important objectives of the present apparatus include the provision of a leg stretching apparatus adaptable for use by both adults and children; the provision of a leg stretching apparatus having adjustable leg engaging members which the user may reposition with little effort; the provision of a leg stretching apparatus having leg engaging members for contact with the user's leg at points above and below a knee joint to avoid knee injury by imparting a lesser force to the lower leg.

DETAILED DESCRIPTION OF THE PREFERRED EMBODIMENTS

Figure 1:
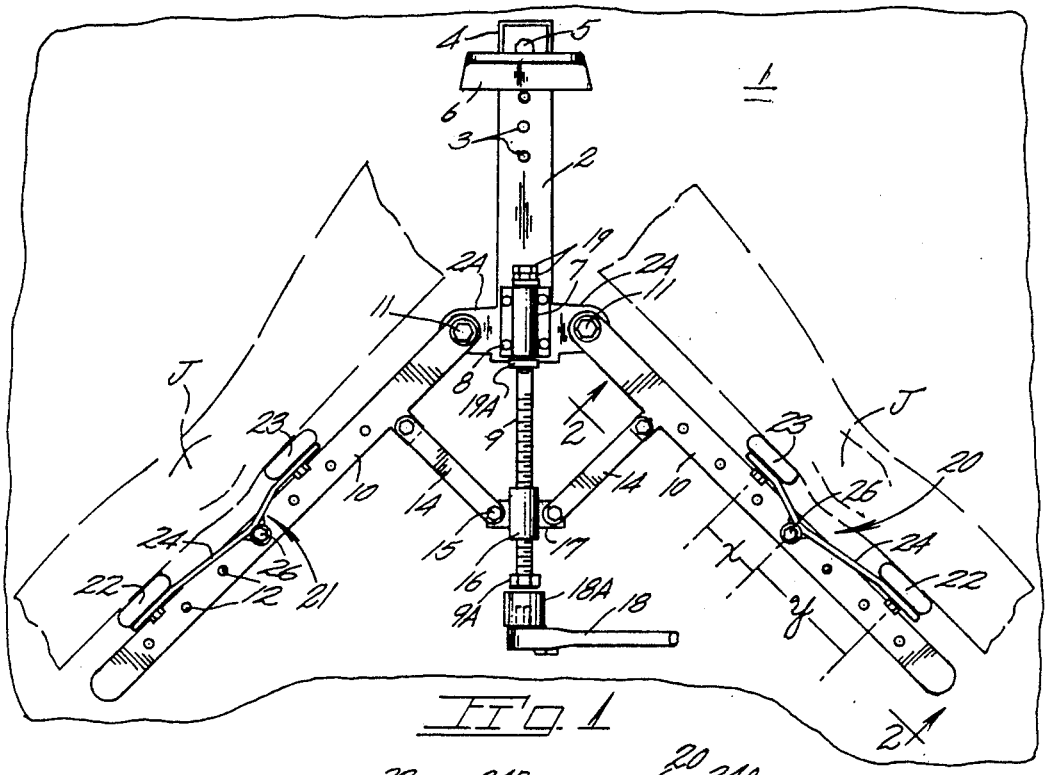
FIG. 1 is a plan view of the present leg stretching apparatus with a user's legs shown in fragmentary phantom lines.

With continuing attention to the drawings wherein applied reference numerals indicate parts similarly hereinafter identified, the reference numeral 1 indicates a floor surface.

A base 2 of the present apparatus is embodied in an elongate plate having a series of apertures 3 adjacent its rearward end 4 to receive a fastener 5 which serves to attach a backrest 6 to the base. A forward end of the base receives a bearing 7 suitably attached to the base as by screws 8 with bearing 7 serving to journal an end segment of a threaded shaft 9.

A pair of arms 10 are swingably attached at their intermost ends to the forward end of the base by means of fastener assemblies 11 which extend through apertured lateral extensions 2A of the base. Each arm is provided with a series of openings 12 to receive later described leg engaging members.

Arm positioning means includes a pair of links 14 attached at their ends to each of said arms while their inner ends are pivotally mounted at 15 to a traveler sleeve 16 in place on threaded shaft 9. Traveler sleeve 16 includes a pair of flanges 17 on which the link ends are pivotally mounted. For advancement of traveler sleeve along threaded shaft 9 a ratchet-type hand tool 18 is provided with a socket 18A engageable with a head 9A on shaft 9. Shaft 9 is retained against axial displacement by lock nuts 19 and a collar 19A.

Figure 2:
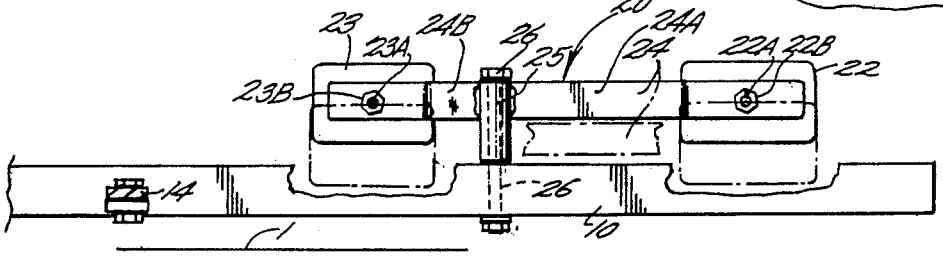
FIG. 2 is a vertical sectional view taken along line 2—2 of FIG. 1.

Leg engaging members generally at 20 and 21 are carried by arms 10 and include pads at 22 for contact with the user's legs below the knee joint while pads at 23 are contactable with the legs above the knee joint indicated at J. Leg engaging member 21 would be a mirror image of leg engaging member 20 best shown in FIG. 2. An elongate member 24 of each leg engaging member is swingably supported by a sleeve 25 pivotally attached to an arm member by a bolt assembly 26. Accordingly, upon leg contact of the pads 22 and 23 with the inner side of a user's leg, the leg engaging members will pivot about bolt assembly 26 so as to distribute the load to the leg above and below knee joint J. As shown in FIG. 2, the elongate member 24 is secured in an asymmetrical manner to sleeve 25 i.e., adjacent one end of sleeve 25, whereby upon removal and inversion of the leg engaging member and reattachment to the other arm (by insertion of bolt assembly 26 through the sleeve) each pad 22–23 will be located closer to floor surface 1 to accommodate a small adult or child. Accordingly, the pads 22 and 23 retain their positions relative the knee joint J. The hand tool 18 may be a conventional ratchet wrench with the socket 18A being torqued in both directions upon setting of the wrench control mechanism. Leg engaging members 20–21 will be installed along arms 10 so as to locate sleeve 25 opposite the user's knee joint J. Further, if so desired, the pads 22 and 23 may be rotated about their mounting studs 22A-23A and secured in position by nut elements 22B-23B to add to the range of pad positioning.

The upper leg pads 23 are offset from the leg assembly pivotal support i.e., bolt assembly 26 a lesser distance at X than the lower leg pads 22 offset a distance indicated at Y for the purpose of assuring the preponderance of force applied to the leg is by upper leg pad 23 to avoid risk of injury to the knee joint. The segment 24A of elongate member 24 is of greater length than segment 24B to provide greater leverage acting about pivot 26.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An apparatus for stretching the upper leg muscles of adults and children, said apparatus comprising, an elongate base including a backrest for placement on a floor surface, arms each pivotally attached at one of their ends to said base adjacent one end of the base, arm positioning means including a threaded shaft journalled on said base, a traveler sleeve on said shaft, links pivotally coupled to said traveler sleeve and said arms to impart arcuate opening and closing movement to the arms upon rotation of of said shaft, manually operable means including a ratchet mechanism for imparting rotation to said shaft for movement of said traveler sleeve along the shaft, and leg engaging members one each pivotally mounted on said arms and each including an elongate member, pads on each elongate member for contact with the inner side of the leg above and below the knee joint of the leg.

2. The apparatus claimed in claim 1 wherein said leg engaging members each further include a sleeve, fastener means extending through said sleeve and one of said arms, said elongate member carried by said sleeve.

3. The apparatus claimed in claim 2 wherein said elongate member is transversely attached to the side of said sleeve asymmetrically along the longitudinal axes of said sleeve whereby upon removal of the sleeve from the fastening means and upon inverting of the leg engaging member the pads thereon will be relocated at a different height from the floor surface to best adapt the apparatus to a user.

4. An apparatus for stretching the upper leg muscles of adults and children, said apparatus comprising, an elongate base including a backrest for placement on a floor surface, arms each pivotally attached at one of their ends to said base adjacent one end of the base, arm positioning means including a threaded shaft journalled on said base, a traveler sleeve on said shaft, links pivotally coupled to said traveler sleeve and said arms to impart arcuate opening and closing movement to the arms upon rotation of said shaft, manually operable means for imparting rotation to said shaft for movement of said traveler sleeve along the shaft, and leg engaging members one each pivotally mounted on said arms and each including an elongate member, pads on each elongate member for contact with the inner side of the leg above and below the knee joint of the leg, said leg engaging members each further including a sleeve, fastener means extending through said sleeve and one of said arms, said elongate member carried by said sleeve and transversely attached to the side of the sleeve asymmetrically along the longitudinal axes of said sleeve whereby upon removal of the sleeve from the fastening means and upon inverting of the leg engaging member the pads thereon will be relocated at a different height from the floor surface to best adapt the apparatus to a user.

* * * * *